United States Patent [19]

Packham et al.

[11] 3,933,276

[45] Jan. 20, 1976

[54] HEATING AND DISPENSING APPARATUS

[75] Inventors: Charles C. Packham, Wokingham; Raymond G. Parsonage, Maidenhead, both of England; Donald L. Underwood, Holliston, Mass.

[73] Assignee: The Gillette Company, Boston, Mass.

[22] Filed: Dec. 9, 1974

[21] Appl. No.: 530,992

[52] U.S. Cl. ..... 222/146 HE

[51] Int. Cl.[2] ..... B67D 5/62

[58] Field of Search ..... 222/146 HA, 146 HE; 165/154, 155

[56] References Cited

UNITED STATES PATENTS

| | | | |
|---|---|---|---|
| 3,247,851 | 4/1966 | Seibert | 222/146 HE |
| 3,307,747 | 3/1967 | Pacitti | 222/146 HA |
| 3,335,910 | 8/1967 | Rossi | 222/146 HA |
| 3,527,922 | 8/1970 | Reich et al. | 222/146 HA |
| 3,589,559 | 6/1971 | Colton | 222/146 HE |
| 3,712,512 | 1/1973 | Snider | 222/146 HA |
| 3,733,460 | 5/1973 | Ryckman, Jr. | 222/146 HA |
| 3,749,880 | 7/1973 | Meeks | 222/146 HA |

*Primary Examiner*—Stanley H. Tollberg
*Assistant Examiner*—Hadd Lane
*Attorney, Agent, or Firm*—Richard A. Wise; Oistein J. Bratlie; Raymond J. Devellis

[57] ABSTRACT

A dispenser for use in dispensing a product in heated condition from a pressurized container. The dispenser includes a main housing for removably receiving and holding the container and a heat exchanger assembly mounted in the main housing and spaced apart from the container. The heat exchanger assembly comprises a cup-like mass of a heat conductive material and includes an elongated passageway in its wall of a depth substantially equal to that of the wall and extending from the inlet to the outlet of the heat exchanger assembly. The product is directed in a single predetermined direction through the elongated passageway from the inlet to the outlet of the heat exchanger assembly. Further, an electrical heater is disposed along the inner wall of the cup-like mass and a circuit for connecting the heater to a source of power is provided. A thermostatic switch in the circuit is disposed within the heat exchanger assembly to disconnect the power source when the heat exchanger assembly reaches the desired temperature.

27 Claims, 9 Drawing Figures

HEATING AND DISPENSING APPARATUS

BACKGROUND OF THE INVENTION

This invention relates to a combination heating and dispensing device for a product packaged in a pressure container of the type commonly known as an aerosol container. More particularly, this invention is concerned with a dispenser for heating and dispensing foam shaving lather.

Combined heating and dispensing devices for pressurized containers of shaving cream or lather have previously been proposed. However, they have suffered from a variety of disadvantages, principally in their inability to efficiently heat an adequate supply of foamed lather at a sufficiently high rate of discharge at the desired temperature, as well as from the risk of overheating.

The present invention provides a device overcoming these difficulties which is constructed and arranged with a housing for removably receiving and holding a conventional pressurized container of shaving cream. The container includes a conventional outlet valve actuated by moving its associated outlet nozzle. Mounted within the housing and spaced apart from the pressurized container is a heat exchanger assembly having an inlet and an outlet and comprising a cup-like mass of a heat conductive material, such as a metal. The wall portion of the cup-like mass includes an elongated passageway of a depth substantially equal to that of the wall portion and extending from the inlet to the outlet of the heat exchanger assembly. Means is provided for directing the product in a single predetermined direction from the inlet to the outlet of the heat exchanger assembly. Means is also provided for connecting the heat exchanger assembly to the container comprising a fitting movably mounted within the housing in position to engage in sealing relation to the outlet nozzle of the container and a flexible conduit connecting the fitting to the inlet of the heat exchanger assembly and a manually actuated means provided for moving the fitting when engaged with the outlet nozzle to actuate the outlet valve. A conduit connects the outlet of the heat exchanger assembly to a delivery spout extending through the housing and an electrical resistance heater is disposed along the inner wall of the cup-like mass with a circuit for connecting the heater to a source of power. The circuit includes a thermostatic switch or thermostat disposed within a cup-like mass to disconnect the power source from the heater when the cup-like mass of the heat exchanger assembly reaches the desired temperature.

In a preferred embodiment, the circuit includes a locking relay assembly which keeps the power source connected to the heater until the thermostat opens. When the thermostat opens, the locking relay assembly is de-energized and the power source is prevented from being automatically reconnected to the heater when the temperature of the cup-like mass of the heat exchanger assembly drops below the desired level. Manually actuable means may be provided for reconnecting the power source to the heater when the cup-like mass, and hence the thermostat, has cooled below the desired useful temperature.

Also in a preferred embodiment, the heat exchanger assembly includes a separate inner and outer cup-like mass which together define the elongated passageway between their respective walls.

Improved temperature control can be achieved by providing a well or cavity at the inner face of the wall of the cup-like mass and mounting the thermostatic switch in the well between the cup-like mass and the heater.

SUMMARY OF THE INVENTION

It is an object of this invention to provide heating and dispensing apparatus which will efficiently heat an adequate supply of a product, such as a shaving cream or lather, at a sufficiently high rate of discharge at a desired temperature.

It is also an object of this invention to provide heating and dispensing apparatus which will operate efficiently and without a substantial risk of overheating.

It is a further object of this invention to provide heating and dispensing apparatus which is reliable and provides ease of assembly and construction.

Briefly stated, and according to an aspect of this invention, the foregoing objects are achieved by providing heating and dispensing apparatus including a heat exchanger assembly having a cup-like mass of a heat conductive material and having an elongated passageway of a depth substantially equal to that of the wall of the cup-like mass. The cup-like mass may be integrally formed to include the elongated passageway in its wall or may be formed to define the elongated passageway between the respective walls of separate concentrically positioned inner and outer cup-like members. The product is directed in a single predetermined direction through the elongated passageway and electrical means to prevent reconnection of the power source to the heater after the desired temperature is reached may be provided.

BRIEF DESCRIPTION OF THE DRAWINGS

The invention both as to its organization and principles of operation together with further objects and advantages thereof may better be understood by referring to the following detailed description of embodiments of the invention when taken in conjunction with the accompanying drawings, in which.

DESCRIPTION OF THE PREFERRED EMBODIMENTS

Figure 1:
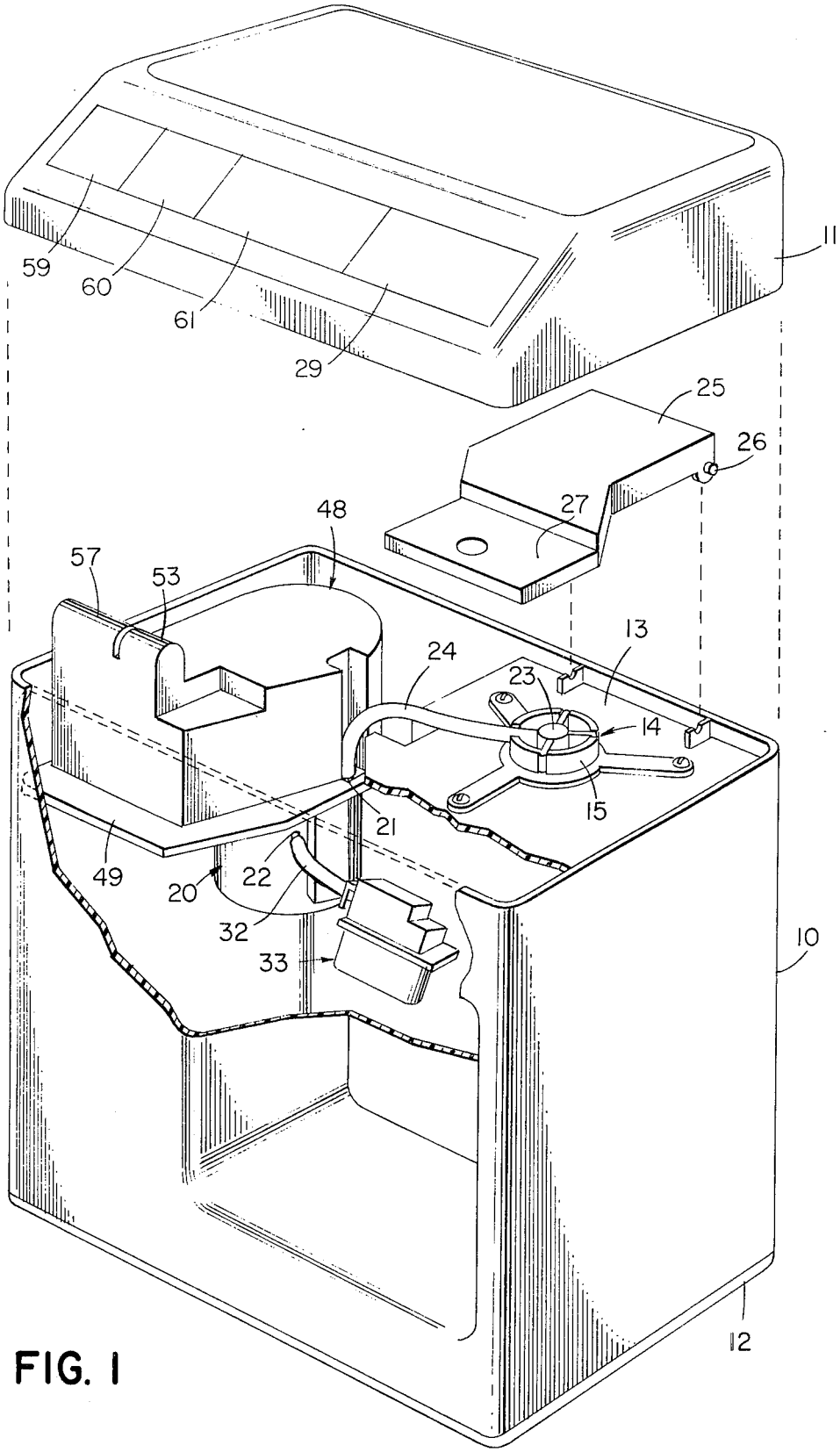
FIG. 1 is an isometric view, partially broken away, illustrating an exemplary embodiment of the cover of the housing and the actuating lever separated from the remainder of the housing, in accordance with this invention.
Figure 2:
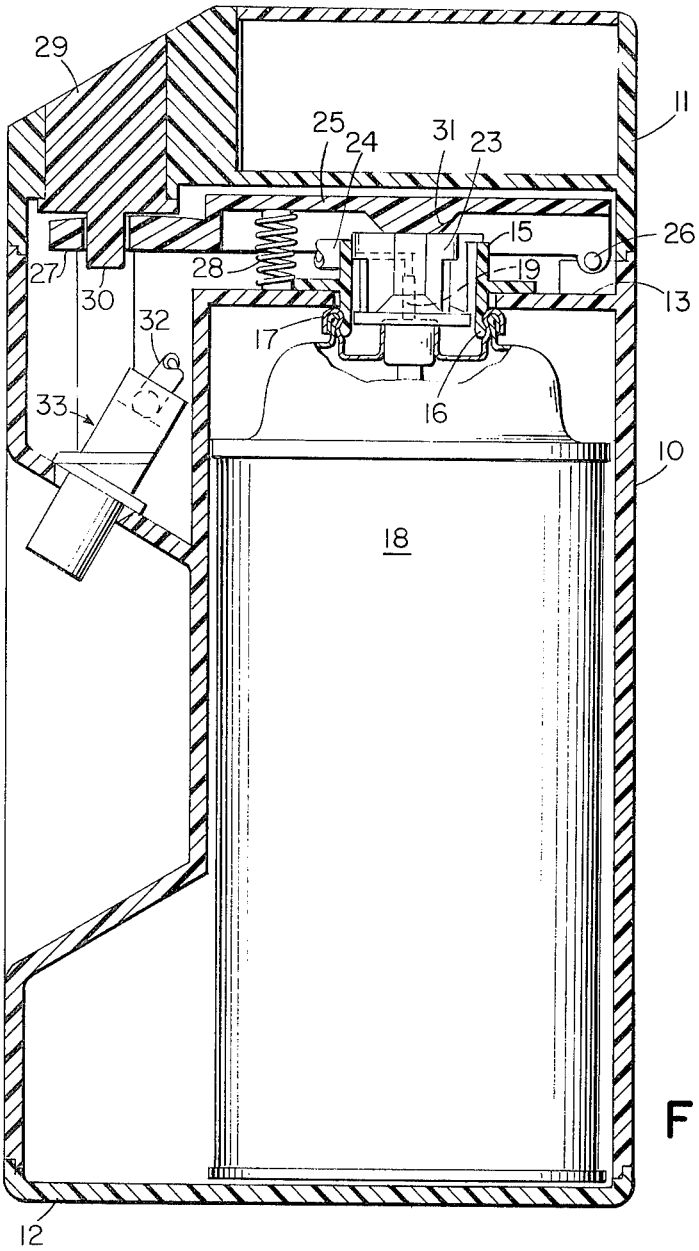
FIG. 2 is a view in vertical section illustrating an exemplary embodiment and including the pressurized container, in accordance with this invention.

Referring now to FIGS. 1 and 2, the heating and dispensing apparatus includes a housing formed of molded plastic or the like and having a main body portion 10 and a cover portion 11 bolted or otherwise secured to the top of the main body portion 10. A bottom portion 12 is removably secured to the open bottom end of the main body portion 10 by conventional interlocking grooves and detents along the margins. A partition 13 has secured to it a molded plastic collar 14 having a split skirt 15 extending downwardly through an aperture in the partition 13. At the lower margin of the split skirt 15, a radially outwardly extending flange 16 in position to be releasably engaged within the margin of a conventional mounting ring 17 permanently secured to pressurized container 18 which is filled with materials such as shaving cream and a pressure propellant. An upwardly extending outlet nozzle 19 is mounted on an outlet valve (not shown) which can be actuated in the usual manner by moving the outlet nozzle 19 to discharge the contents of the container 18.

Container 18 can be inserted in or removed from the body portion 10 of the housing by removing the bottom portion 12, whereupon the rolled flange of the mounting ring 17 of the container 18 can be readily engaged or disengaged with the lower portion of the split skirt 15 and its outwardly extending flange 16 of collar 14.

Secured within the main body portion 10 of the housing by suitable brackets is heat exchanger assembly 20 which is spaced apart from the location of the container 18 thus minimizing the transfer of heat from the heat exchanger assembly 20 to the container 18. The heat exchanger assembly 20 is located at the side of the container 18, only as an exemplary embodiment. The heat exchanger assembly 20 may readily be located above and spaced apart from the container 18 which would also minimize the transfer of heat from the heat exchanger assembly 20 to the container 18. When the heat exchanger assembly 20 is mounted above the container 18, suitable mounting brackets which support the heat exchanger assembly 20 above the container 18 and isolate the same from the container 18 are readily provided. Further, with the heat exchanger assembly positioned either above or at the side of the container 18, slots or vents (not shown) for directing the thermal flow may readily be formed in the housing. Such vents would direct the thermal flow to cool the container 18 utilizing the chimney effect or the like. A plurality of generally parallel slots formed in the back side of the housing when the heat exchanger assembly is located at the side of the container or in the side or cover portion of the housing, when the heat exchanger assembly is located above the container, is desirable.

Figure 5:
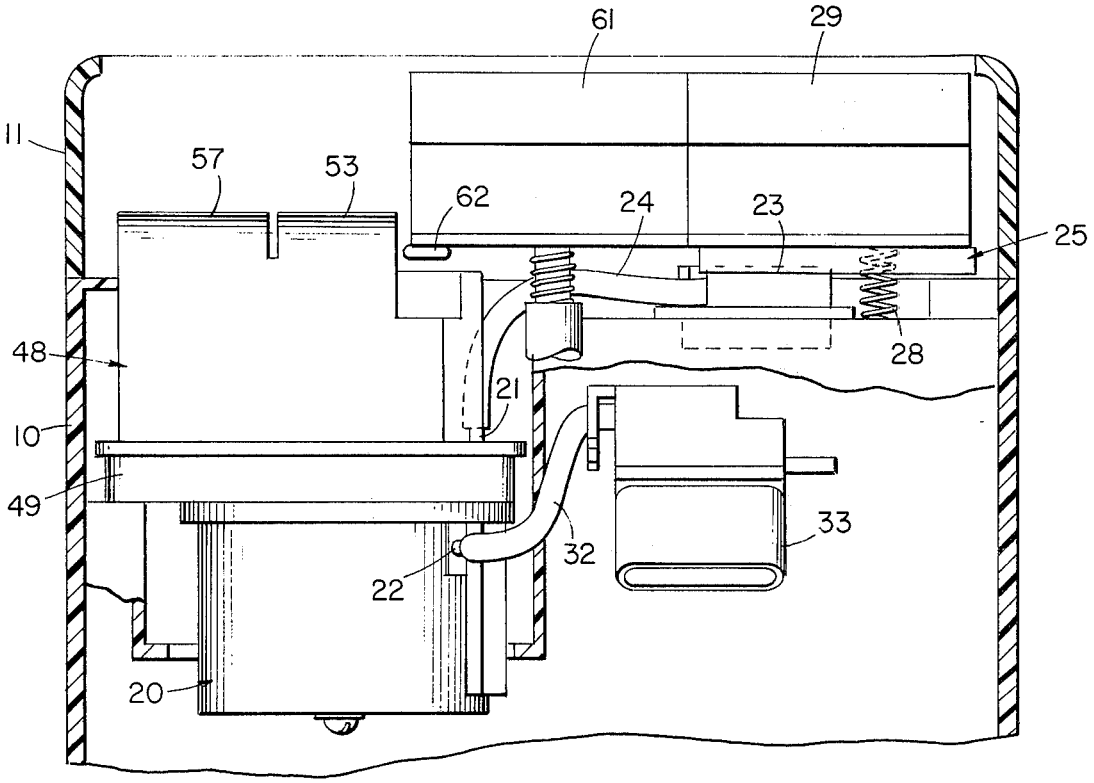
FIG. 5 is a view in front elevation, partially broken away, illustrating an exemplary embodiment of the arrangement of the heat exchanger assembly and the means for connecting the heat exchanger assembly to the container, in accordance with this invention.
Figure 8:
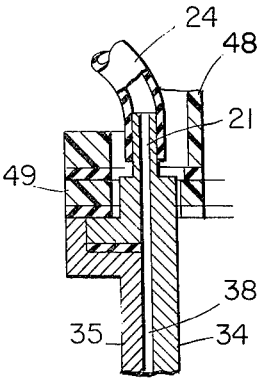
FIG. 8 is a view in vertical elevation, partially broken away and in section, taken along line 8—8 of FIG. 4 illustrating an exemplary embodiment of the inlet to the heat exchanger assembly, in accordance with this invention.

Referring now to FIGS. 1, 2, and 5, the heat exchanger assembly 20 is provided with an inlet 21 and an outlet 22. Means is provided for connecting the heat exchanger assembly 20 to the container 18 in the form of a molded plastic fitting 23 mounted for vertical sliding movement in collar 14 and having a bore of suitable size to make sealing engagement with the outlet nozzle 19. A flexible conduit or hose 24 provides fluid communication between the inlet 21 of the heat exchanger 20 and the bore of fitting 23. A lever 25 is pivotally mounted at 26 on suitable brackets affixed to the main body portion 10 of the housing above partition 13. The free end 27 of the lever 25, which includes an aperture, is urged upwardly by a compression spring 28 seated between the bottom of lever 25 and the top of partition 13.

Slidably mounted in the cover portion 11 of the housing is actuator 29 with its upper surface exposed through an aperture in the housing so as to be accessible for manual actuation from the outside. The bottom margin of actuator 29 includes an extended portion 30 disposed through the aperture in the free end 27 of lever 25. The bottom margin of actuator 29 serves as a stop to limit upward movement of lever 25, and a boss 31 extends downwardly from lever 25 in position to abut against the upper face of fitting 23.

Consequently, when the cover portion 11 is secured in position and the container 18 is inserted as described above, outlet nozzle 19 is simultaneously forced into sealing engagement with the bore of fitting 23. In operation, the bottom margin of actuator 29 bears on the free end 27 of lever 25 causing the lever 25 to move downwardly when actuator 29 is depressed thus, in turn, moving fitting 23 and outlet nozzle 19 to release the product or contents of container 18.

Outlet 22 of the heat exchanger assembly 20 is connected by conduit or hose 32 to delivery spout 33 which is mounted so as to project through an aperture in the main body portion 10 of the housing. An alternate means of releasing the contents of container 18 is to mount the delivery spout 33 on the free end 27 of the lever 25. Depressing the portion of the delivery spout 33 which projects through the aperture in the wall in the body portion 10 of the housing, also depresses the lever 25 causing it to move downwardly thus moving fitting 23 and outlet nozzle 19 to release the contents of container 18.

Figure 6:
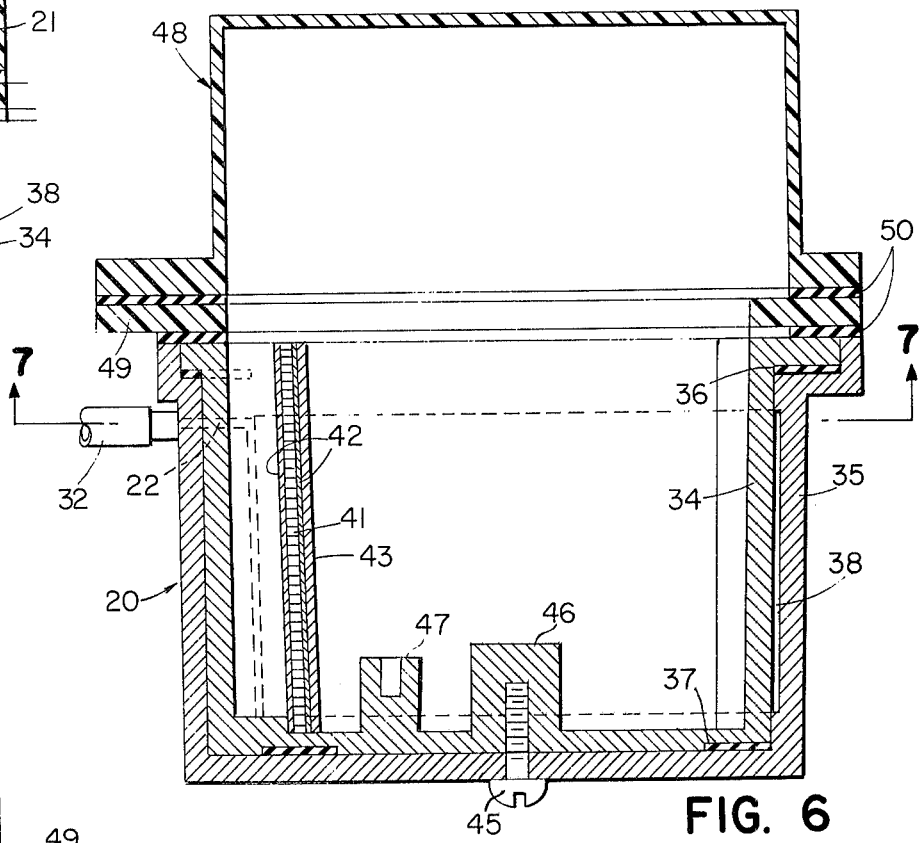
FIG. 6 is a view in vertical section of an exemplary embodiment of the heat exchanger assembly on an enlarged scale, in accordance with this invention.
Figure 9:
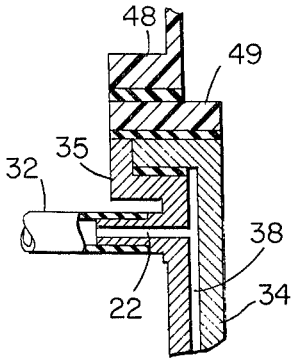
FIG. 9 is a view in vertical elevation, partially broken away and in section, taken along line 9—9 of FIG. 4 illustrating an exemplary embodiment of the outlet from the heat exchanger assembly in accordance with this invention.
Figure 7:
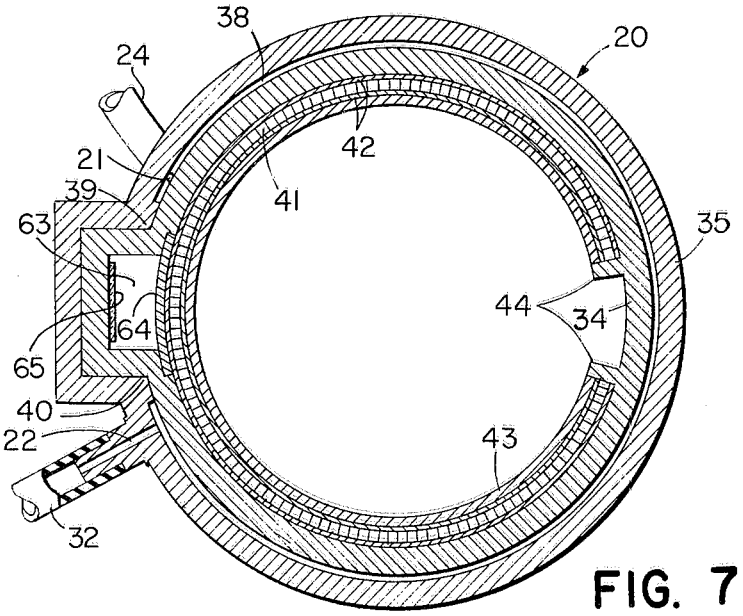
FIG. 7 is a view in section taken along line 7—7 of FIG. 6, in accordance with this invention.

Referring now to FIGS. 6 and 7, the heat exchanger assembly 20 includes a cup-like mass of a heat conductive material such as nickel-plated aluminum or other metal which will also provide adequate protection from corrosion. The wall portion of the cup-like mass includes an elongated passageway 38 preferably of uniform width and of a depth substantially equal to that of the wall portion and extending from the inlet 21 to the outlet 22 of the heat exchanger assembly 20. Although the cup-like mass may be formed as a single, integral unit, the embodiment of FIGS. 6 and 7 illustrate the cup-like mass to comprise inner and outer mating elements or first cup-like member 34 and second cup-like member 35. Cup-like members 34 and 35 are formed, in this embodiment, with their respective wall portions and bottom portions as a single piece unit of the same heat conductive material to aid in providing ease of manufacture and assembly. The cup-like members 34 and 35, when assembled, are sealed together with gasket 36 positioned between upper flange portions of the members and gasket 37 disposed in a concentric groove under the bottom portion of the inner member 34 and thus between the respective bottom portions of the members 34 and 35. Thus, within the formed composite side wall, the elongated passageway 38 is defined extending along most of the length of the side wall.

In the embodiment, utilizing separate mating cup-like members 34 and 35, the total weight of members 34 and 35 formed from nickel-plated aluminum is approximately 92 grams. The total weight or mass and thickness of the members depends on factors such as the type of material, manufacturing requirements, desired heating time, size of heating unit and the like. The formed elongated passageway is of a substantial uniform width from 0.004 inch to 0.100 inch and preferably in the range from 0.008 inch to 0.020 inch. In this embodiment, the actual width is 0.010 inch. The height of the wall portion of the cup-like mass may be in a range of from 0.2 inch to 7.0 inches with the embodiment illustrated being 1.0 inch. The length of the elongated passageway may correspondingly be from 1.0 to 6.0 inches with the embodiment illustrated being 4.5 inches. The heat capacity of the heat exchanger assembly 20 is entirely suitable when in the range of from 5 to 40 calories per degree centigrade above ambient and preferably from 12 to 15 calories per degree centigrade above ambient.

Within these parameters, the dispenser of the present invention, when used with any conventional pressurized container of shaving cream dispensing a foamed lather and having an internal pressure from 15 to 100 p.s.i.g. at room temperature, is capable of delivering foamed lather in large amounts at a spout temperature of up to 100° C and preferably in the range of 50° to 95° C. Pressure propellants such as halogenated hydrocarbons (Freons), butane, nitrogen, and other propellants can be used in the container 18.

Means for directing the product in a single predetermined direction from the inlet 21 to the outlet 22 of the heat exchanger assembly 20 is provided. When utilizing an elongated passageway having a depth substantially equal to the depth of the wall portion of a cup-like mass, it is advantageous to control the direction of product travel and prevent the product from travelling between the inlet and the outlet of the heat exchanger assembly by the shorter route. Thus, the directing means, which may or may not be formed integrally with the cup-like mass, substantially prevents fluid communication in the elongated passageway in one direction between the inlet and the outlet thereby directing fluid communication between the inlet and the outlet through the elongated passageway, which preferably is of the longer length to realizing a more efficient heat exchanger assembly. In a one-piece cup-like mass, the directing means may be integrally formed to block the elongated passageway, preferably between the shorter distance around the length of the wall portion between the inlet and the outlet of the heat exchanger assembly. Also preferably, the inlet and outlet of the heat exchanger assembly are respectively formed substantially immediately adjacent opposite sides of the directing means and formed elongated passageway thereby extends at least fifty percent and preferably substantially the entire length of the wall portion.

In the embodiment of the heat exchanger assembly having first and second cup-like members, mating perpendicular channels may be formed along the outer wall of the inner cup-like member and the inner wall of the outer cup-like member thereby, when assembled, forming the directing means and also aiding in aligning the inner member in its proper position concentrically disposed within the outer member.

In the embodiment of FIG. 7 including a well or cavity (to be described subsequently) the directing means includes the raised portions 39 and 40 of member 35 which substantially prevents fluid communication in the shorter direction between inlet 21 and outlet 22 of heat exchanger assembly 20.

Disposed within the inner cup-like member 34 of the heat exchanger assembly 20 and extending along the inner face of its wall portion is a heating means such as an electrical resistance heater 41 in the form of resistance wire wrapped on a form covered on each side with electrical insulating material 42 such as synthetic mica. The insulating material 42 and the heater 41 are held in place by a biasing means such as a metal spring 43 which in turn is held in place by its own biasing force against the member 34. In FIG. 7, raised portions 44 formed integrally with the inner cup-like member 34 and extending from its inner wall portion may be provided as an alignment aid during assembly.

Although the design of the cup-like mass substantially prevents leakage from its bottom portion, fastening means such as screw 45 may be threaded through the bottom portion of the outer cup-like member 35 and into raised portion 46 integrally formed on the inside bottom portion of the inner cup-like member 34. Also extending on the inside bottom portion of the cup-like mass and formed integrally therewith is a raised mount 47 for a thermal link or fuse to be described subsequently.

Referring to FIGS. 4 through 9, an electrical control circuit for connecting the heater 41 to a source of power is mounted within a water tight cup-like closure housing 48 secured through support member 49 to the open face of the heat exchanger assembly 20 and sealed thereto by means of appropriate gaskets 50. Closure housing 48 together with heat exchanger assembly 20 serves to isolate the electrical components from the container 18 and from any of the contents of the container 18 which might accidently spill in or on the housing and which would otherwise present a safety hazard to the user.

Figure 3:
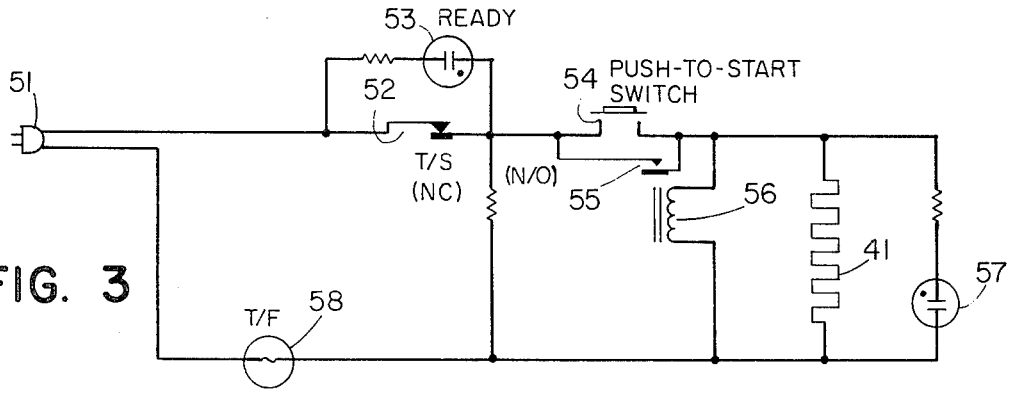
FIG. 3 is a schematic diagram illustrating an exemplary embodiment of an electric circuit utilized in accordance with this invention.

As illustrated in FIG. 3, the circuit includes a connector 51 for connecting the heater 41 to a suitable source of power. Connected in series with the heater 41 is a thermostatic switch such as snap action thermostatic switch 52 which is normally closed at room temperature but which opens when the switch attains the desired temperature. This temperature is chosen to be that which is required to ultimately deliver heated foam at the delivery spout at the desired temperature range. In parallel with the normally closed thermostatic switch 52 is an indicator or pilot light such as a glow discharge tube or light 53 which will light when the circuit is activated and the normally closed thermostatic switch 52 is open. Also in series with the heater 41 is the parallel combination of a normally open magnetically actuated push button switch 54 and a locking relay comprised of a normally open relay contact 55 with its associated armature 56 connected across the heater 41. An indicator or pilot light such as a glow discharge tube or light 57 is connected in parallel with the heater 41 and will light when the heater 41 is functioning. A fusible link or fuse 58 is also provided in the circuit in the usual manner as a safety device, being arranged to melt and open the circuit to the heater 41 if the desired limiting temperature is exceeded within the device.

Figure 4:
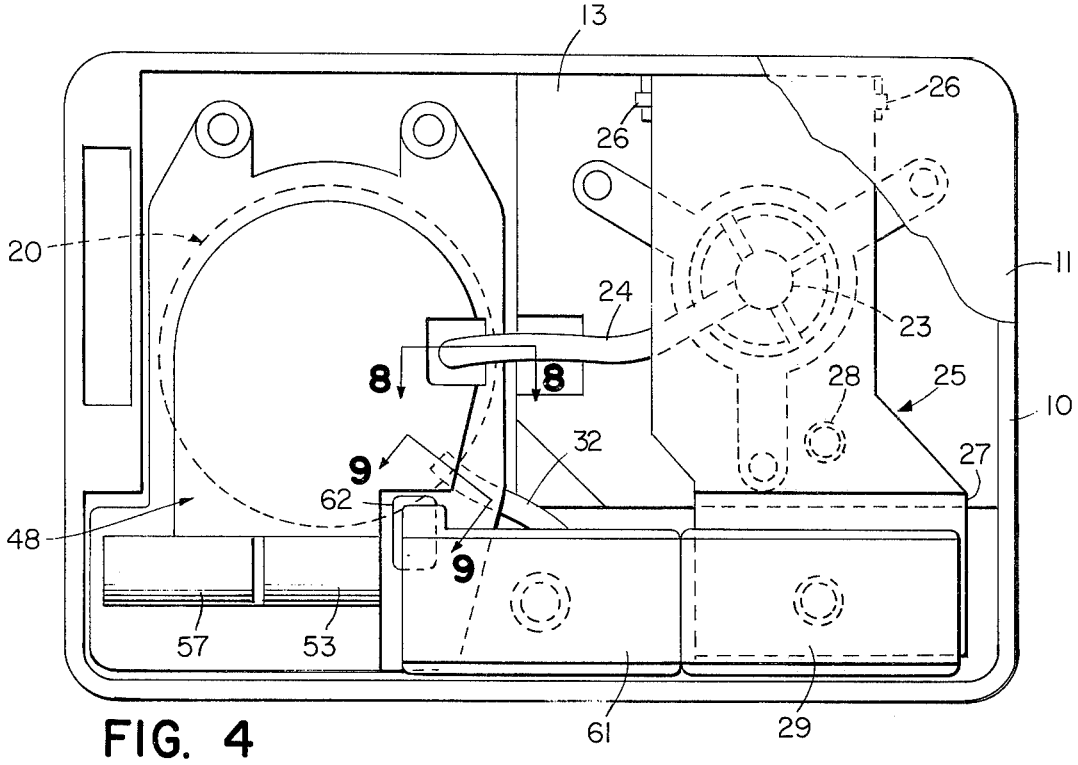
FIG. 4 is a top plan view, partially broken away, illustrating an exemplary embodiment of the heat exchanger assembly and means for connecting the heat exchanger assembly to the container, in accordance with this invention.

Referring to FIGS. 4 and 5, indicator lights at 53 and 57 are mounted within an upper transparent portion of closure housing 48 in position to be visible through housing 48 and sight ports 59 and 60 (FIG. 1) of the cover portion 11 of the housing device. Magnetically actuated switch 54 is also located in the upper forward portion of closure housing 48 in position to be actuated by push button 61 carrying permanent magnet 62 (FIGS. 4 and 5). The fusible link 58 is preferably mounted within the center opening of the cup-like mass in mount 47 described when referring to FIG. 6.

The thermostatic switch 52 is also located within the center opening of the cup-like mass of the heat exchanger assembly 20. However, in a preferred embodiment, (FIGS. 6 and 7) the thermostatic switch 52 is oriented in a well or cavity 63 located in the inner wall of the heat exchanger assembly 20 to provide the proper rate of heat flow into the thermostat. More particularly, the thermostatic switch 52 is positioned between a heat conductive member 64 and a heat insulating member 65. It has been found that positioning the thermostatic switch 52 in the well 63 between the heat conductive member 64 and the heat insulating member 65 provides for consistent and reliable switching at the desired temperature range of the thermostatic switch 52. All of the components of the electrical circuit, except for connector 51 and its leads, are sealed within the water tight enclosure formed by the heat exchange assembly 30, closure housing 48 and support member 49.

In operation of the device, after insertion of the pressurized container 18 as described above and connection of the circuit to a suitable source of power, push button 61 is momentarily closed to close magnetic switch 54. Thermostatic switch 52 being normally closed, the closing of switch 54 energizes armature 56 thereby closing normally open relay contact 55 and supplying power to heater 41. Simultaneously, indicator or pilot light 57 glows indicating that heating is taking place. When thermostatic switch 52 reaches the design temperature which is not necessarily equal to the design temperature of the thermostatic switch alone, it opens causing the locking relay to open, thereby disconnecting the heater 41 from the power supply. Once the power supply is interrupted to the heater 41 by means of the opening of normally closed thermostatic switch 52 at the design temperature, armature 56 of the locking relay, since it also has its power supply substantially disconnected, becomes deenergized and thereby releases its hold on normally open relay contact 55 which returns to its normally open position thereby preventing reconnection of the heater 41 to the power source when the temperature of the thermostatic switch 52 drops below the desired level. Of course, indicator light 57 is responsive to the condition of heater 41 and will go out whenever the power source is interrupted to the heater 41 such as when the normally closed thermostat 52 is open. Indicator light 53 at the same time comes on and stays on as long as thermostat 52 is open indicating that the heat exchanger assembly 20 has reached and is above its minimum design operating temperature.

Other circuits may be used in the practice of this invention either with or without the means for preventing reconnection of the power source to the heating means when the temperature of the cup-like mass of the heat exchanger assembly reaches the desired level. For example, a circuit employing the thermostatic switch such as a drift type thermostatic switch and a separate on-off switch is applicable.

After the indicator light 53 comes on to indicate that the heat exchanger assembly 20 has reached its operating temperature as described above, actuator 29 is then depressed manually, moving outlet nozzle 19 and opening the valve of the container 18. Foam discharged from the container 18 passes through elongated passageway 38 of the heat exchanger assembly 20 propelled by the pressure within the container 18 and emerges in heated form through spout 33. As soon as the temperature of thermostatic switch 52 drops below its design level, it assumes its normally closed position, bypassing indicator light 53 and causing the latter to be extinguished. No further power is delivered to the heater 41 until push button 61 is once again closed, thus, obviating the possibility of continuous heating thereby increasing the useful life of the assembly.

Accordingly, it has been shown that by providing heating and dispensing apparatus as discussed herein at a reliable and safe system may be achieved. While embodiments and applications of this invention have been shown and described, it will be apparent to those skilled in the art that many more modifications are possible without departing from the inventive concepts herein described. The invention, therefore, is not to be restricted except as is necessary by the prior art and by the spirit of the appended claims.

What is claimed as new and desired to be secured by Letters Patent of the United States is:

1. Apparatus for heating and dispensing a product from an outlet of a pressurized container comprising:

a housing for removably receiving and holding the pressurized container;

a heat exchanger assembly mounted in said housing and spaced apart from the pressurized container, said heat exchanger assembly having an inlet and an outlet and including a cup-like mass of a heat conductive material having a wall portion, said wall portion having a single thin deep elongated passageway of a substantially uniform width and of a depth substantially equal to that of said wall portion and extending for a distance less than the circumference of said cup-like mass from said inlet to said outlet of said heat exchanger assembly;

means for directing the product from said inlet to said outlet of said heat exchanger assembly in a single predetermined direction through said elongated passageway, said directing means being positioned between said inlet and said outlet of said heat exchanger assembly thereby preventing the product from traveling through said cup-like mass a distance greater than the circumference of said cup-like mass;

manually actuable means for actuating the outlet valve of the pressurized container thereby releasing the product from the pressurized container;

means for connecting the outlet of the pressurized container to said inlet of said heat exchanger assembly;

means for connecting said outlet of said heat exchanger assembly to a delivery spout extending through said housing;

heating means disposed within said heat exchanger assembly in a heat transfer relationship with said wall portion to provide heat to the product in said elongated passageway through said wall portion; and circuit means for connecting said heating means to a power source.

2. Apparatus as in claim 1 wherein said circuit mans includes electrical means disposed within said heat exchanger assembly for disconnecting said heating means from the power source when a desired temperature is reached.

3. Apparatus as in claim 2 wherein said electrical means includes a normally closed thermostatic switch and said heating means is substantially disconnected from the power source when said thermostatic switch reaches the desired temperature.

4. Apparatus as in claim 3 wherein a well is provided at the inner face of said wall portion and said thermostatic switch is disposed in said well between said cup-like mass and said heating means.

5. Apparatus as in claim 4 further including a heat insulating member disposed in said well between said cup-like mass and said thermostatic switch and a heat conductive member disposed in said well between said thermostatic switch and said heating means.

6. Apparatus as in claim 1 wherein said inlet and said outlet of said heat exchanger assembly are respectively formed adjacent opposite sides of said means for directing the product, and said elongated passageway extends through at least over 50 percent of the circumference of said cup-like mass.

7. Apparatus as in claim 6 wherein said means for directing the product is integrally formed with said wall portion.

8. Apparatus as in claim 1 wherein said heating means includes an electrical resistance heater substantially disposed along said wall portion of said heat exchanger assembly.

9. Apparatus as in claim 1 wherein the heat capacity of the heat exchanger assembly is in the range of from 12 to 15 calories per degree centigrade above ambient.

10. Apparatus as in claim 1 including means for directing the thermal flow away from the pressurized container.

11. Apparatus as in claim 10 wherein said means for directing the thermal flow includes vent means disposed through said housing.

12. Apparatus as in claim 1 wherein the outlet valve of the pressurized container is actuated by moving an associated outlet nozzle, said means for connecting the outlet of the pressurized container to said inlet of said heat exchanger assembly including a fitting movably mounted within said housing and positionable to engage in a sealing relationship with the outlet nozzle of the pressurized container, and further including a flexible conduit connecting said fitting to said inlet of said heat exchanger assembly.

13. Apparatus as in claim 12 wherein said manually actuable means for actuating the outlet valve of the pressurized container includes means for moving said fitting when engaged with the outlet nozzle to actuate the pressurized container.

14. Apparatus as in claim 13 wherein said means for connecting said outlet of said heat exchanger assembly to said delivery spout includes a flexible conduit.

15. Dispensing apparatus for heating and dispensing a product from an outlet of a pressurized container comprising:

a main housing for removably receiving and holding the pressurized container;

a heat exchanger assembly mounted in said housing and spaced apart from the pressurized container, said heat exchanger assembly having an inlet and an outlet and including a first and second separate cup-like mass each formed of a heat conductive material and each having a wall portion, said first cup-like mass being disposed in said second cup-like mass thereby defining a single thin deep elongated passageway between each of said respective wall portions of a substantially uniform width and of a depth substantially equal to that of each of said wall portions and extending for a distance less than the circumference of said cup-like mass from said inlet to said outlet of said heat exchanger assembly;

means for directing the product from said inlet to said outlet of said heat exchanger assembly in a single predetermined direction, through said elongated passageway, said directing means being positioned between said inlet and said outlet of said heat exchanger assembly thereby preventing the product from traveling through said cup-like mass a distance greater than the circumference of said cup-like mass;

manually actuable means for actuating the outlet valve of the pressurized container thereby releasing the product from the pressurized container;

means for connecting the outlet of the pressurized container to said inlet of said heat exchanger assembly;

conduit means for connecting said outlet of said heat exchanger assembly to a delivery spout extending through said housing;

heating means disposed within said heat exchanger assembly in a heat transfer relationship with said wall portions to provide heat to the product in said elongated passageway through said wall portion; and circuit means for connecting said heating means to a power source and including a thermostatic switch disposed within said heat exchanger assembly for disconnecting said heating means from the power source when said thermostatic switch reaches the desired temperature.

16. Dispensing apparatus as in claim 15 wherein a well is provided at the inner face of said wall portion of said first cup-like mass and said thermostatic switch is disposed within said well between said first cup-like mass and said heating means.

17. Dispensing apparatus as in claim 16 further including a heating insulating member disposed in said well between said first cup-like mass and said thermostatic switch and a heat conductive member disposed in said well between said thermostatic switch and said heating means.

18. Dispensing apparatus as in claim 15 wherein said inlet and said outlet of said heat exchanger assembly are respectively formed adjacent opposite sides of said means for directing the product, and a first portion of said means for directing the product is integrally formed with said first cup-like mass and a second portion of said means for directing the product is integrally formed with said second cup-like mass and said elongated passageway extends between said wall portion of said first and second cup-like masses for at least over fifty percent of the outer circumference of said first cup-like mass.

19. Apparatus as in claim 15 wherein the heat capacity of the heat exchanger assembly is in the range of from 12 to 15 calories per degree centigrade above ambient.

20. Apparatus for heating and dispensing a shaving cream from an outlet of a pressurized container comprising:

a housing for removably receiving and holding the pressurized container;

a heat exchanger assembly mounted in said housing and spaced apart from the pressurized container, said heat exchanger assembly having an inlet and an outlet and including a cup-like mass of a heat conductive material having a wall portion, said wall portion having a single thin deep elongated passageway of a substantially uniform width and of a depth substantially equal to that of said wall portion and extending for a distance less than the circumference of said cup-like mass from said inlet to said outlet of said heat exchanger assembly;

means for directing the shaving cream from said inlet to said outlet of said heat exchanger assembly in a single predetermined direction through said elongated passageway, said directing means being positioned between said inlet and said outlet of said heat exchanger assembly thereby preventing the shaving cream from traveling through said cup-like mass a distance greater than the circumference of said cup-like mass;

manually actuable means for actuating the outlet valve of the pressurized container thereby releasing the shaving cream from the pressurized container;

means for connecting the outlet of the pressurized container to said inlet of said heat exchanger assembly;

means for connecting said outlet of said heat exchanger assembly to a delivery spout extending through said housing;

heating means disposed within said heat exchanger assembly in a heat transfer relationship with said wall portion to provide heat to the shaving cream in said elongated passageway through said wall portion;

circuit means for connecting and disconnecting said heating means to a power source; and electrical means, including a locking relay assembly connected to said circuit means and disposed within said heat exchanger assembly, responsive to the disconnection of the power source for preventing reconnection of the power source to said heating means when the temperature of said cup-like mass of said heat exchanger assembly reaches the desired level.

21. Apparatus as in claim 20 wherein said electrical means includes a normally closed thermostatic switch and said heating means is disconnected from the power source when said thermostatic switch reaches the desired temperature.

22. Apparatus as in claim 20 wherein said locking relay assembly includes an armature having an associated normally open relay contact, said armature when energized causing the closing of said normally open relay contact and electrically connecting the power source to said heating means, said armature when de-energized, in response to the desired temperature being reached, causing the releasing of said normally open relay contact and the disconnecting of the power source from said heating means.

23. Apparatus as in claim 22 including a closure housing for the central opening of said cup-like mass.

24. Apparatus as in claim 23 wherein said electrical means also includes a magnetically actuated switch disposed within said closure housing and a push button carrying a magnet mounted on said housing adjacent said closure housing for actuating said switch.

25. Apparatus as in claim 20 wherein said circuit means includes manually actuable means for connecting the power source to said heating means.

26. Apparatus as in claim 20 wherein said cup-like mass includes a first and second separate cup-like mass each formed of a heat conductive material and each having a wall portion, said first cup-like mass being disposed in said second cup-like mass thereby defining the elongated passageway between each of said respective wall portions, of a depth substantially equal to that of each of said wall portions.

27. Apparatus as in claim 26 wherein a well is provided at the inner face of said wall portion of said first cup-like mass and said thermostatic switch is disposed in said well between said first cup-like mass and said heating means and further including a heat insulating member disposed in said well between said first cup-like mass and said thermostatic switch and a heat conductive member disposed in said well between said thermostatic switch and said heating means.

* * * * *